US011511549B2

(12) United States Patent
Nabeshima et al.

(10) Patent No.: US 11,511,549 B2
(45) Date of Patent: Nov. 29, 2022

(54) LIQUID EJECTION APPARATUS, LIQUID EJECTION HEAD, AND RECOVERY METHOD

(71) Applicant: CANON KABUSHIKI KAISHA, Tokyo (JP)

(72) Inventors: Naozumi Nabeshima, Tokyo (JP); Kazuhiro Yamada, Yokohama (JP); Yohei Nakamura, Yokohama (JP); Yoshiyuki Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/081,206

(22) Filed: Oct. 27, 2020

(65) Prior Publication Data

US 2021/0129553 A1 May 6, 2021

Related U.S. Application Data

(62) Division of application No. 16/122,041, filed on Sep. 5, 2018.

(30) Foreign Application Priority Data

Sep. 29, 2017 (JP) ..... JP2017-191297

(51) Int. Cl.
*B41J 2/185* (2006.01)
*B41J 2/175* (2006.01)

(52) U.S. Cl.
CPC ..... *B41J 2/185* (2013.01); *B41J 2/175* (2013.01)

(58) Field of Classification Search
None
See application file for complete search history.

(56) References Cited

U.S. PATENT DOCUMENTS

| | | | | |
|---|---|---|---|---|
| 6,010,254 | A | 1/2000 | Sanada | 396/604 |
| 6,247,789 | B1 | 6/2001 | Sanada | 347/45 |
| 6,283,574 | B1 | 9/2001 | Sugimoto et al. | |
| 6,312,111 | B1 | 11/2001 | Kimura et al. | |
| 6,994,416 | B2 | 2/2006 | Seki et al. | |

(Continued)

FOREIGN PATENT DOCUMENTS

| | | |
|---|---|---|
| CN | 1136499 A | 11/1996 |
| CN | 1646324 | 7/2005 |

(Continued)

OTHER PUBLICATIONS

Office Action dated Jun. 1, 2021 in counterpart Japanese Application No. 2017-191297, together with English translation thereof.

(Continued)

*Primary Examiner* — Erica S Lin
*Assistant Examiner* — Tracey M McMillion
(74) *Attorney, Agent, or Firm* — Venable LLP

(57) ABSTRACT

A liquid ejection apparatus capable of suppressing the amount of liquid to discharge by recovery processing is provided. The liquid ejection apparatus includes: a first path fluidly connected to an ejection port unit and provided with a deformable region; and a second path fluidly connected to the first path via the ejection port unit and provided with a deformable region. Here, a flow of liquid is generated between the first path and the second path by a displacement unit.

6 Claims, 7 Drawing Sheets

(56) References Cited

U.S. PATENT DOCUMENTS

| | | | | |
|---|---|---|---|---|
| 7,270,409 | B2 | 9/2007 | Iwasaki et al. | |
| 7,395,778 | B2 | 7/2008 | Iwasaki et al. | |
| 7,556,339 | B2 | 7/2009 | Nakagawa et al. | |
| 7,588,639 | B2 | 9/2009 | Iwasaki et al. | |
| 7,650,850 | B2 | 1/2010 | Iwasaki et al. | |
| 8,087,744 | B2 | 1/2012 | Nakagawa et al. | |
| 8,517,518 | B2 | 8/2013 | Kashu et al. | 347/66 |
| 8,991,954 | B2 | 3/2015 | Govyadinov et al. | 347/6 |
| 9,724,926 | B2 | 8/2017 | Keefe et al. | |
| 9,914,303 | B2 * | 3/2018 | Kudo | B41J 2/17596 |
| 9,925,792 | B2 | 3/2018 | Aoki et al. | B41J 2/17596 |
| 9,994,040 | B2 | 6/2018 | Karita et al. | |
| 10,179,455 | B2 | 1/2019 | Keefe et al. | B41J 2/17596 |
| 2005/0212856 | A1 | 9/2005 | Temple et al. | 347/46 |
| 2007/0058009 | A1 | 3/2007 | Furukawa et al. | |
| 2009/0219313 | A1 | 9/2009 | Suzuki et al. | |
| 2012/0113197 | A1 | 5/2012 | Kashu et al. | 347/89 |
| 2013/0169710 | A1 | 7/2013 | Keefe et al. | 347/17 |
| 2014/0118431 | A1 | 5/2014 | Govyadinov et al. | 347/6 |
| 2015/0091989 | A1 | 4/2015 | Govyadinov et al. | 347/89 |
| 2016/0279930 | A1 | 9/2016 | Date | B41J 2/04541 |
| 2017/0197434 | A1 | 7/2017 | Aoki et al. | B41J 2202/20 |
| 2017/0266967 | A1 | 9/2017 | Kudo | |

FOREIGN PATENT DOCUMENTS

| | | | |
|---|---|---|---|
| CN | 101352964 | A | 1/2009 |
| CN | 101518988 | A | 9/2009 |
| JP | H09-179273 | | 7/1997 |
| JP | 2007076016 | A | 3/2007 |
| JP | 2012-101415 | | 5/2012 |
| JP | 2013-539724 | | 10/2013 |
| JP | 2014-527490 | | 10/2014 |
| JP | 2015112796 | A * | 6/2015 |
| JP | 2017-124612 | | 7/2017 |
| JP | 2017-165054 | | 9/2017 |

OTHER PUBLICATIONS

Office Action dated Mar. 4, 2021 in counterpart Chinese Application No. 201811117280.9.

Chinese Office Action, dated Jul. 21, 2020, in corresponding Chinese Application No. 201811117280.9.

* cited by examiner

LIQUID EJECTION APPARATUS, LIQUID EJECTION HEAD, AND RECOVERY METHOD

CROSS-REFERENCE TO RELATED APPLICATIONS

This application is a divisional of U.S. patent application Ser. No. 16/122,041, filed Sep. 5, 2018, which claims the benefit of Japanese Patent Application No. 2017-191297, filed Sep. 29, 2017. The foregoing applications are incorporated herein by reference in their entireties.

BACKGROUND OF THE INVENTION

Field of the Invention

The present invention relates to a liquid ejection apparatus and liquid ejection head provided with a recovery function to excellently maintain the ejection state of liquid, and to a recovery method.

Description of the Related Art

In a printing apparatus which prints by ejecting liquid, high-speed printing and high-quality printing with respect to a regular paper are requested, and therefore a liquid with high viscosity may be used for the liquid to eject. However, in the case of the liquid with high viscosity, once the viscosity of liquid increases due to the evaporation of moisture from an ejection port for ejecting liquid, then optimum ejection may become impossible. Then, Japanese Patent Laid-Open No. 2007-076016 discloses a method including the steps of: recovering an ejection state by pressurizing the ink inside an ink container and ejecting the same from an ejection port; and suppressing the amount of ink to discharge by keeping the volume of the ink container at a volume that is obtained in a case where a negative pressure optimum for ejection is set.

However, for example in a case where an ejection head is kept warm in order to eject a liquid with high viscosity, or in a case where the temperature of an ejection head rises in continuously ejecting liquid, this high temperature facilitates the evaporation of moisture from the liquid and accordingly the frequency of executing a recovery action will increase. Thus, the recovery action by ejection might increase the amount of liquid to discharge.

SUMMARY OF THE INVENTION

Accordingly, the present invention provides a liquid ejection apparatus and liquid ejection head capable of suppressing the amount of liquid to discharge by recovery processing, and a recovery method. Therefore, the liquid ejection apparatus of the present invention includes: an ejection port unit configured to eject liquid from an ejection port; a first path which is a path of liquid and is fluidly connected to the ejection port unit; and a second path which is a path of liquid and is fluidly connected to the first path via the ejection port unit. Here, each of the first path and the second path has, at a portion in contact with the liquid flowing through the path, a deformable region formed from a flexible member. The apparatus further includes a displacement unit capable of deforming the deformable region of at least one of the first path and the second path.

According to the present invention, a liquid ejection apparatus and recovery method capable of suppressing the amount of liquid to discharge by recovery processing can be realized.

Further features of the present invention will become apparent from the following description of exemplary embodiments with reference to the attached drawings.

DESCRIPTION OF THE EMBODIMENTS

First Embodiment

Hereinafter, a first embodiment of the present invention will be explained with reference to the accompanying drawings.

Figure 1:
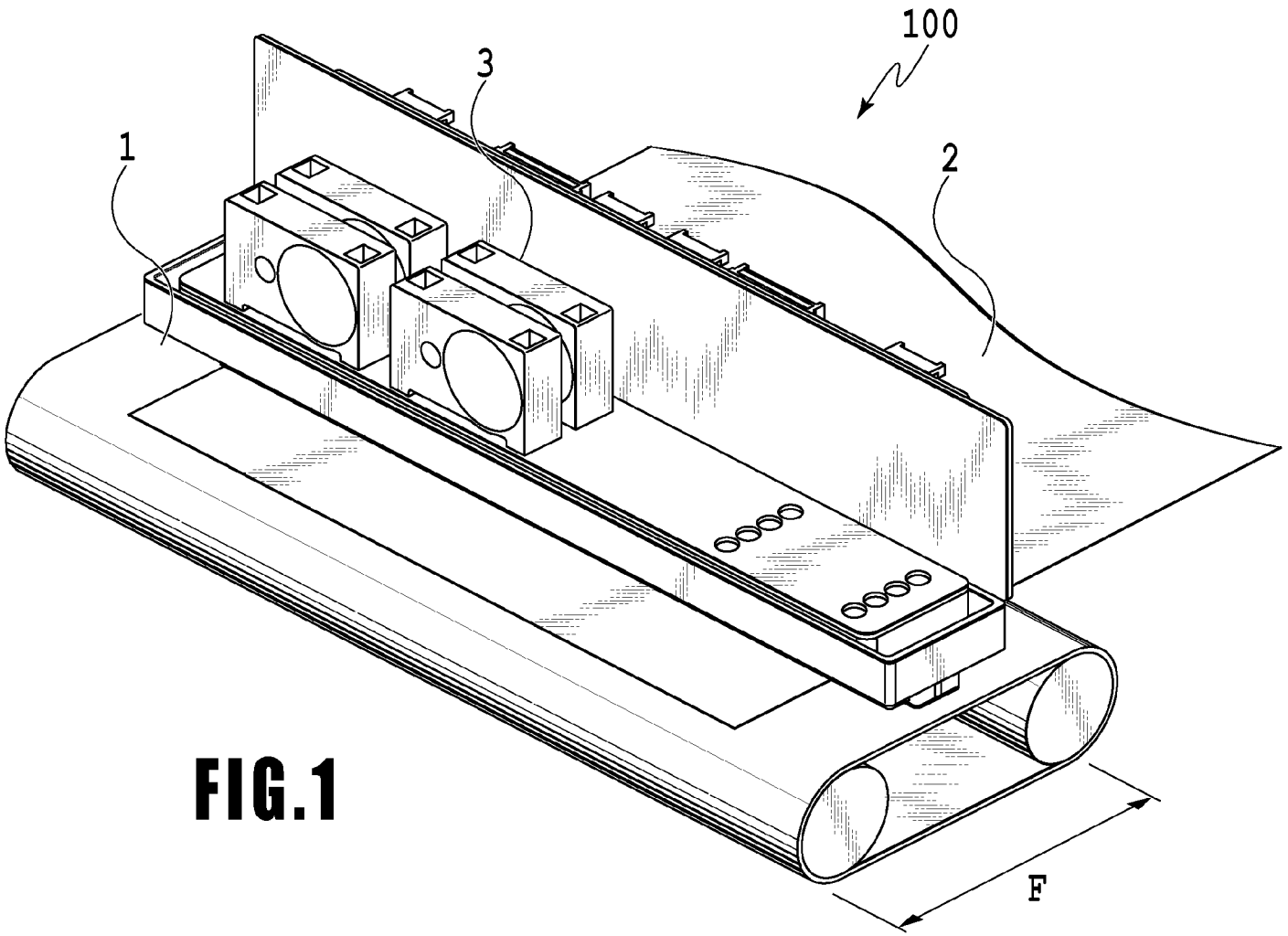
FIG. 1 is a perspective view illustrating a main portion of a liquid ejection apparatus.

FIG. 1 is a perspective view illustrating a main portion of a liquid ejection apparatus 100 to which this embodiment is applicable. The liquid ejection apparatus 100 includes a conveying unit 1 configured to convey a medium 2, and an ejection head 3 which ejects liquid from an ejection port to the medium 2 to be conveyed. In ejecting liquid, the ejection head 3 ejects, without being displaced, liquid to the medium 2 to be continuously conveyed. The medium 2 is not limited to a cut sheet, but may be a continuous roll sheet. Hereinafter, a case will be explained, where printing is performed on the medium 2 using ink as the liquid ejected by the ejection head 3.

The ejection head 3 is capable of full-color printing with CMYK (cyan: C, Magenta: M, yellow: Y, black: K) inks. A liquid supply unit, which is a supply path for supplying ink to the ejection head 3, a main tank, and a buffer tank are fluidly connected to the ejection head 3. Moreover, an electric control unit configured to transmit electric power and an ejection control signal to the ejection head 3 is electrically connected to the ejection head 3.

Figure 2A:
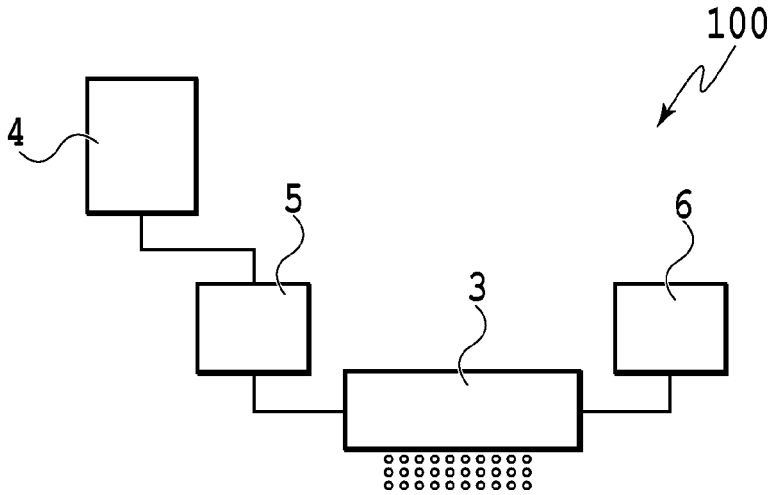
FIG. 2A illustrates a liquid container, an ejection head, a first path, and a second path.
Figure 2B:
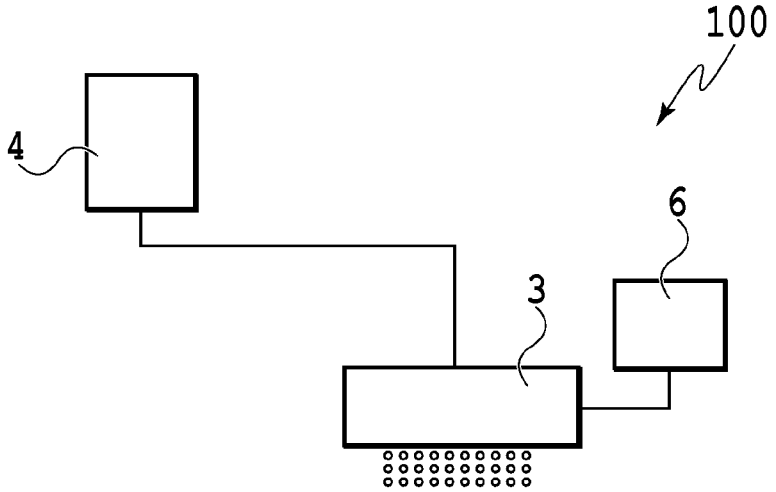
FIG. 2B illustrates the liquid container, the ejection head, the first path, and the second path.
Figure 2C:
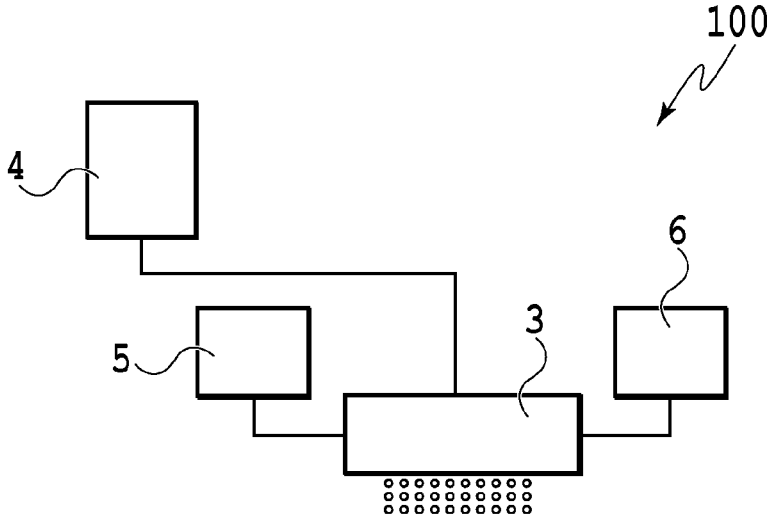
FIG. 2C illustrates the liquid container, the ejection head, the first path, and the second path.

FIG. 2A to FIG. 2C illustrate a liquid container 4, the ejection head 3, a first path 5, and a second path 6 in the liquid ejection apparatus 100. The liquid ejection apparatus 100 in this embodiment includes a path (called an inflow path) through which ink flows into the ejection head 3 and a path (called an outflow path) through which ink flows out from the ejection head 3, and either one of the paths includes a displacement unit configured to displace ink. By providing the ink displacement unit in either one of the inflow path or the outflow path and displacing the ink inside the path in this manner, it is possible to swing and stir the ink inside the ejection head 3 and diffuse the thickened ink at an ejection port unit 22.

Note that both the inflow path and the outflow path may include the displacement unit. Moreover, another member may include the displacement unit so as to displace the ink inside the path, while neither the inflow path nor the outflow path includes the displacement unit. The ejection port unit 22 in the present invention refers to an ejection port 7 and a liquid holding region in the vicinity thereof, as described later. The ejection port unit 22 is an example of a region which includes the ejection port 7 and a pressure chamber 28 including an energy generation element 8 (FIG. 3A) therein.

In the connection mode of FIG. 2A, the liquid container 4 is connected to the ejection head 3 via the first path 5, and the ejection head 3 is further connected to the second path 6. The ink supplied from the liquid container 4 is supplied to the ejection head 3 via the first path 5 and moves to the second path 6. By providing the displacement unit in either the first path 5 or the second path 6 to displace ink, it is possible to swing and stir the ink in the ejection port unit of the ejection head 3, diffuse the thickened ink, and recover an ejection state.

In the connection mode of FIG. 2B, the liquid container 4 is directly connected to the ejection head 3, and the ejection head 3 is further connected to the second path 6. The ink contained in the liquid container 4 is directly supplied to the ejection head 3 and moves to the second path 6. In this case, by providing the displacement unit in either the liquid container 4 or the second path 6 to displace ink, it is possible to swing and stir the ink in the ejection port unit of the ejection head 3, diffuse the thickened ink, and recover an ejection state.

In the connection mode of FIG. 2C, each of the liquid container 4, the first path 5, and the second path 6 is directly connected to the ejection head 3. The ink supplied to the ejection head 3 from the liquid container 4 will move to the first path 5 and the second path 6. In this case, by providing the displacement unit in either one of the first path 5 and the second path 6 to displace ink, it is possible to swing and stir the ink in the ejection port unit of the ejection head 3, diffuse the thickened ink, and recover an ejection state.

Note that here three types of connection modes of the liquid ejection apparatus 100 have been explained, but the invention is not limited thereto. The liquid ejection apparatus 100 may include the first path and second path connected each other via the ejection head 3 so as to be able to swing and stir the ink of the ejection head 3 using a displacement unit included in at least one of the first path and the second path. Moreover, the ejection head 3 may include the first path 5 and the second path 6, and the ejection head 3 may further include a displacement unit 10.

Figure 3A:
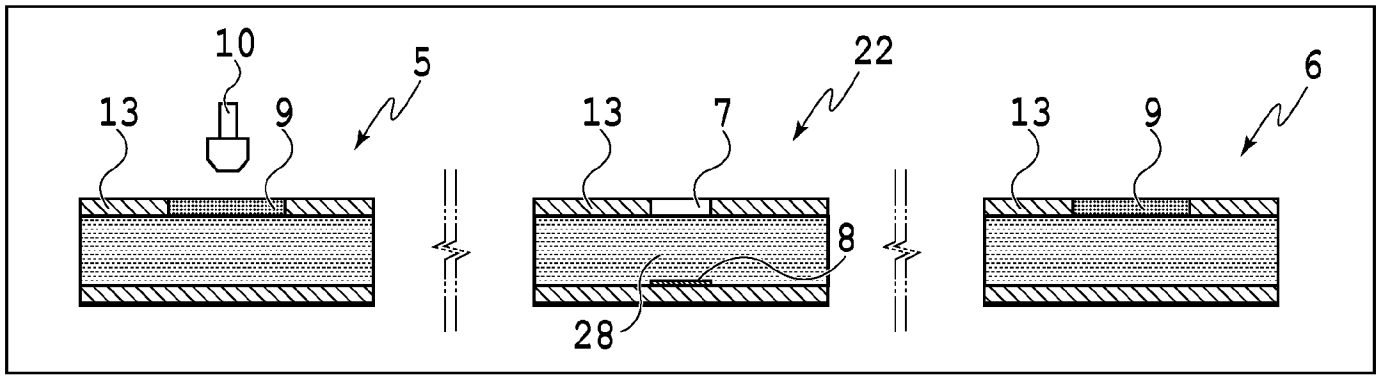
FIG. 3A illustrates the first path, an ejection port unit, and the second path.
Figure 3B:
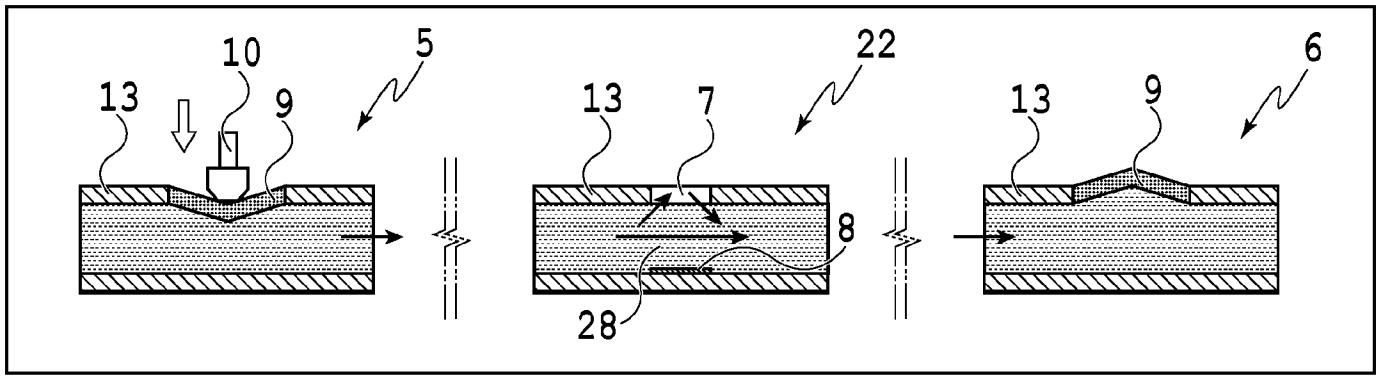
FIG. 3B illustrates the first path, the ejection port unit, and the second path.
Figure 3C:
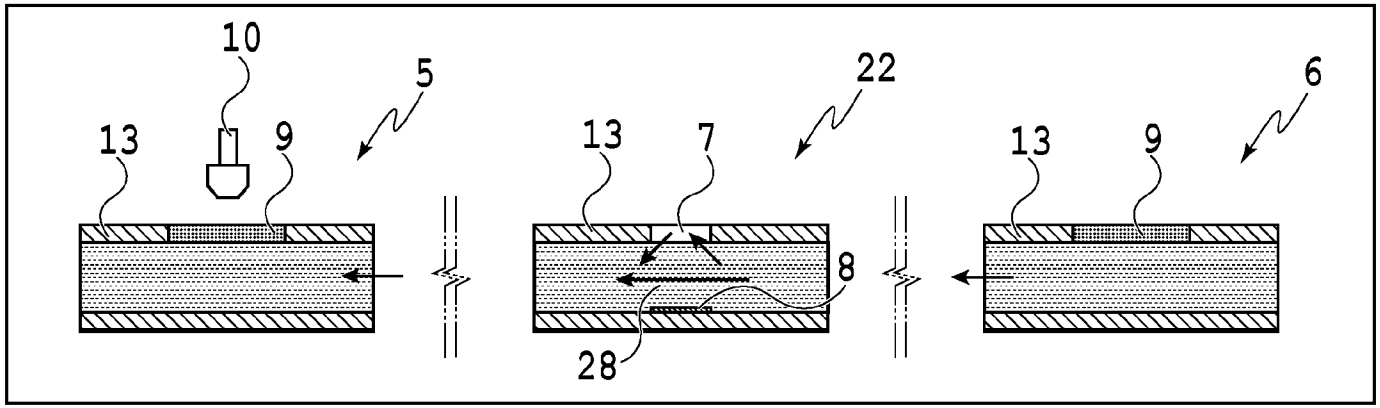
FIG. 3C illustrates the first path, the ejection port unit, and the second path.

FIG. 3A to FIG. 3C illustrate the first path 5, the ejection port unit 22, and the second path 6. The ejection port unit 22 is a region including the ejection port 7 and the pressure chamber 28. The pressure chamber 28 is provided at a position facing the ejection port 7 and includes the energy generation element 8 therein for generating the energy for ejecting liquid. As described above with reference to FIG. 2A, the ejection head 3 includes a plurality of ejection ports and the first path 5 and second path 6 corresponding thereto, but hereinafter, features of the invention will be explained using and ejection head 3 one ejection port, and the first path 5 and second path 6 corresponding thereto.

As illustrated in FIG. 3A, in the first path 5, there are provided: a deformable region 9 which is a part of the path and which is capable of contacting the ink flowing through the path and which is formed from a flexible member; and the displacement unit 10 configured to displace the ink inside the first path 5 by an action of the deformable region 9. In the ejection port unit 22, there are provided: the ejection port 7 for ejecting ink; and a heater 8, which is an energy generation element, at a position facing the ejection port 7. Note that, the energy generation element 8 is not limited to a heater, but various types of energy generation elements, such as a piezoelectric element, can be applicable. In the second path 6, as with the first path 5, there is provided the deformable region 9, which is a part of the path and which is formed from a flexible member. The first path 5 and the second path 6 are formed from an elastic body 13.

As illustrated in FIG. 3B, once the deformable region 9 of the first path 5 is deformed by the displacement unit 10 provided in the first path 5, then the volume of the first path 5 reduces, so that the ink inside the first path 5 starts to move, resulting in a flow of ink toward the ejection port unit 22. The flow of ink generated in the first path 5 flows through the vicinity of the ejection port 7 in the ejection port unit 22, and in the second path 6 deforms the deformable region 9 so as to increase the volume of the second path 6. Then, as illustrated in FIG. 3C, once the displacement unit 10 of the first path 5 is retreated to restore the deformation of the deformable region 9 to the original shape, then the deformable region 9 which has been deformed will return to the state before deformation so as to increase the volume of the first path 5, thus resulting in a flow from the ejection port unit 22 toward the first path 5. The flow from the ejection port unit 22 toward the first path 5 will flow through the vicinity of the ejection port 7 at the ejection port unit 22, and the deformable region 9 which has been deformed so as to increase the volume of the second path 6 will return to the state before deformation. As described above, the liquid inside the pressure chamber 28 will be circulated from and to an outside of the pressure chamber 28.

By repeating such a series of actions, the ink thickened in the ejection port unit 22 is swung and stirred to mix up with the un-thickened ink in the peripheral thereof, allowing the thickening of ink in the ejection port unit 22 to be dissolved. As a result, as compared with a method of recovering an ejection state by discharging the thickened ink from the ejection port unit 22, it is possible to recover an ejection state in the ejection port unit 22 while suppressing the amount of ink to discharge, and it is possible to suppress the occurrence of printing failures associated with the thickening of ink.

As described above, a liquid ejection apparatus includes: a first path fluidly connected to an ejection port unit and provided with a deformable region; and a second path fluidly connected to the first path via the ejection port unit 22 and provided with a deformable region. Here, a flow of liquid is generated between the first path and the second path by the displacement unit. Thus, a liquid ejection apparatus and recovery method capable of suppressing the amount of liquid to be discharged by recovery processing can be realized.

Second Embodiment

Hereinafter, a second embodiment of the present invention will be explained with reference to the accompanying drawings. Note that, because the basic configuration of this embodiment is the same as the configurations of the first embodiment, hereinafter only characteristic configurations will be explained.

Figure 4A:
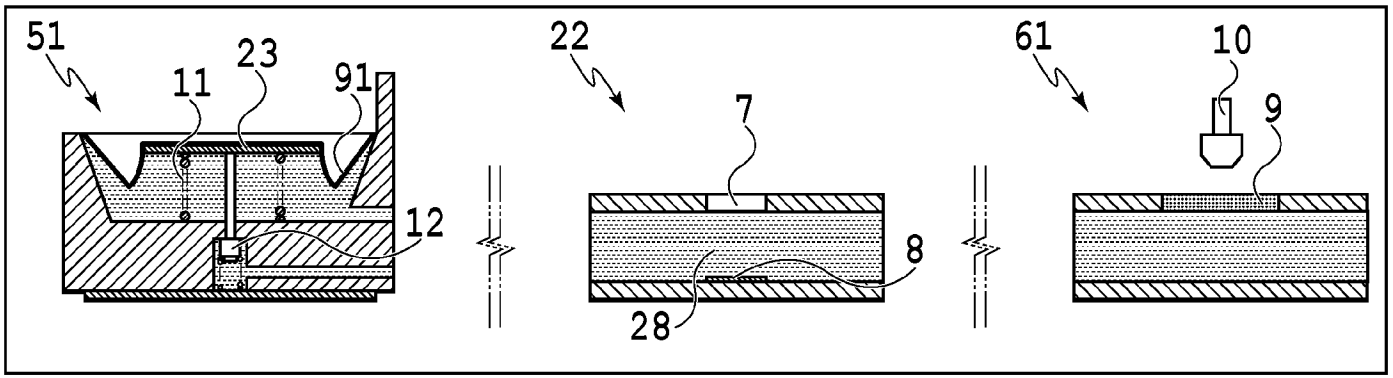
FIG. 4A illustrates a first path, the ejection port unit, and a second path.
Figure 4B:
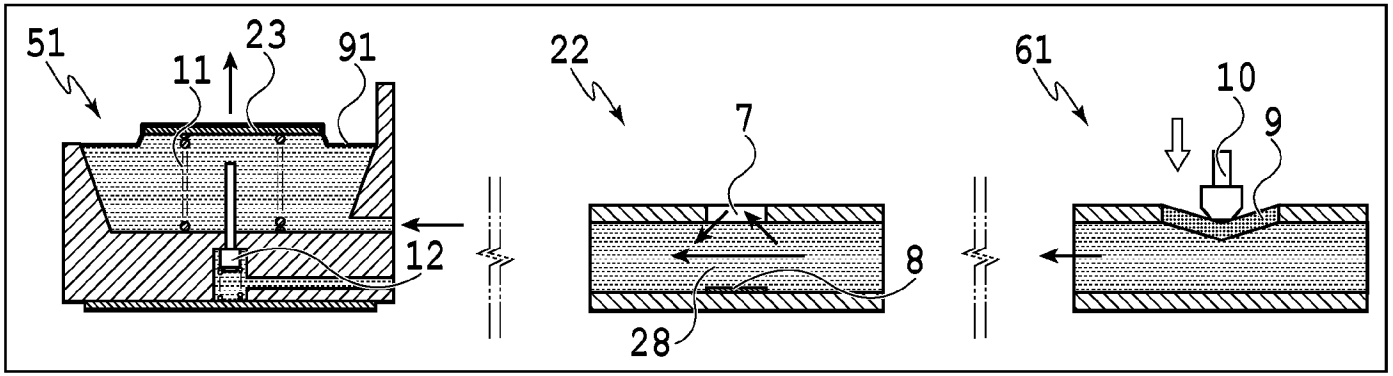
FIG. 4B illustrates the first path, the ejection port unit, and the second path.
Figure 4C:
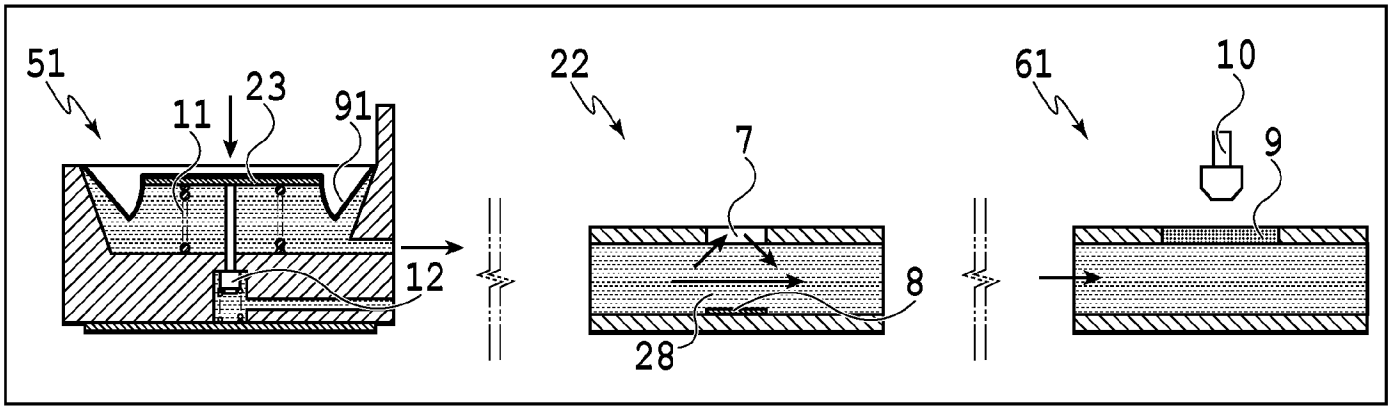
FIG. 4C illustrates the first path, the ejection port unit, and the second path.

FIG. 4A to FIG. 4C illustrate a first path 51, the ejection port unit 22, and a second path 61 in this embodiment. As illustrated in FIG. 4A, the first path 51 of this embodiment includes: a deformable region 91 which is a part of the path and which is formed from a flexible member; and a valve mechanism 12 capable of supplying ink to the first path 51. A plate member 23 is provided in the flexible member of the deformable region 91 of the first path. The plate member 23 is urged by a spring 11 in a direction (lower side in the view) to contract the deformable region 91 and abuts against the valve mechanism 12. Moreover, in the second path 61, there are provided: the deformable region 9 which is a part of the path and which is formed from a flexible member; and the displacement unit 10 configured to displace the ink inside the second path 61 by an action of the deformable region 9.

In this embodiment, since the valve mechanism 12 is provided in the first path 51, ink will not flow to the upstream side of the first path 51 (to the liquid container 4 side) while the valve mechanism 12 is being closed. As illustrated in FIG. 4B, once the deformable region 9 of the second path 61 is deformed by the displacement unit 10 provided in the second path 61, then the volume of the second path 61 reduces, so that the ink inside the second path 61 starts to move, resulting in a flow of the ink toward the ejection port unit 22. The flow of the ink generated in the second path 61 will flow through the vicinity of the ejection port 7 at the ejection port unit 22, and in the first path 51 deforms the deformable region 91 so as to increase the volume of the first path 51 against the urge of the spring 11. Thereby, the plate member 23 will leave the valve mechanism 12. In this case, since the valve mechanism 12 is provided, ink will not flow to the upstream side of the first path 51.

Then, as illustrated in FIG. 4C, once the displacement unit 10 of the second path 61 is retreated to restore the deformation of the deformable region 9 to the original shape, then the deformable region 9 which has been deformed will return to the state before deformation so as to increase the volume of the second path 61. This results in a flow from the ejection port unit 22 toward the second path 61 and a flow from the first path 51 toward the ejection port unit 22. The flow generated in the ejection port will flow through the vicinity of ejection port 7 in the ejection port unit 22, and the deformable region 91 which has been deformed so as to increase the volume of the first path 51 will return to the state before deformation along with the urging force of the spring 11. Then, the plate member 23 abuts against the valve mechanism 12 again.

By repeating such a series of actions, the ink thickened in the ejection port unit 22 is swung and stirred to mix up with the un-thickened ink in the peripheral thereof, allowing the thickening of ink in the ejection port unit 22 to be dissolved. As a result, compared with a method of recovering an ejection state by discharging the thickened ink from the ejection port unit 22, it is possible to recover an ejection state in the ejection port unit 22 while suppressing the amount of ink to discharge, and it is possible to suppress the occurrence of printing failures associated with the thickening of ink.

Third Embodiment

Hereinafter, a third embodiment of the present invention will be explained with reference to the accompanying drawings. Note that, because the basic configuration of this embodiment is the same as the configurations of the previous embodiments, hereinafter only characteristic configurations will be explained.

Figure 5A:
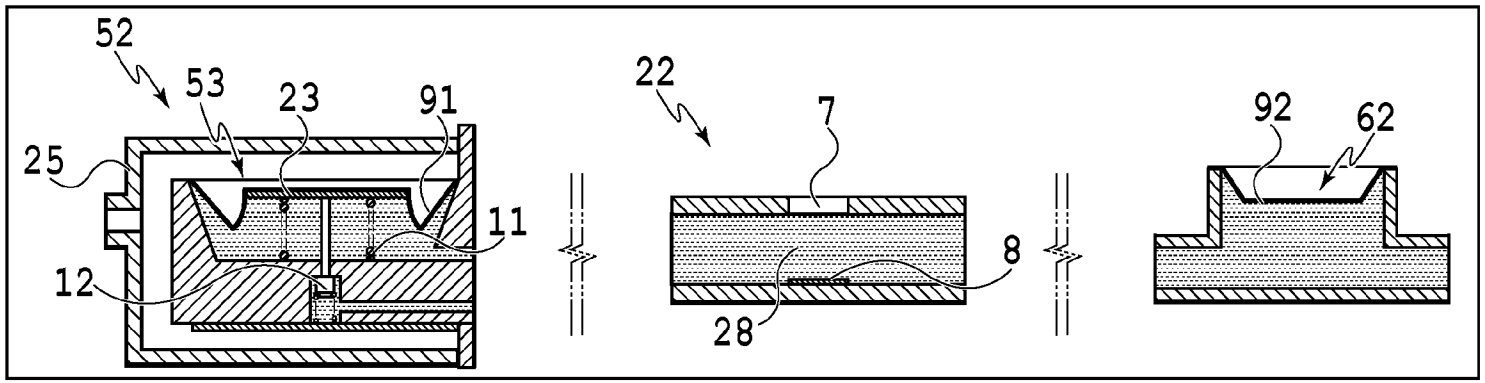
FIG. 5A illustrates a displacement path, the ejection port unit, and a second path.
Figure 5B:
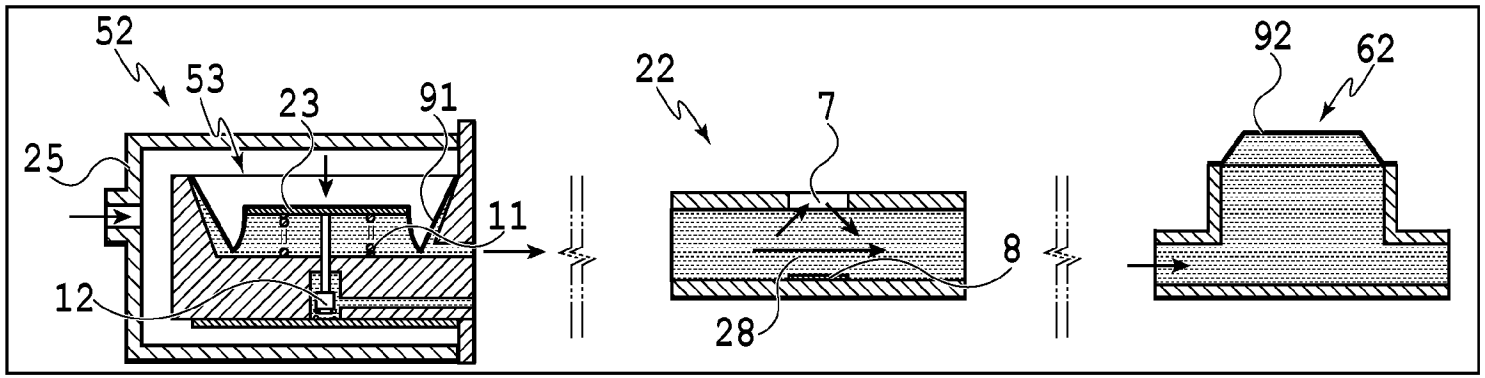
FIG. 5B illustrates the displacement path, the ejection port unit, and the second path.
Figure 5C:
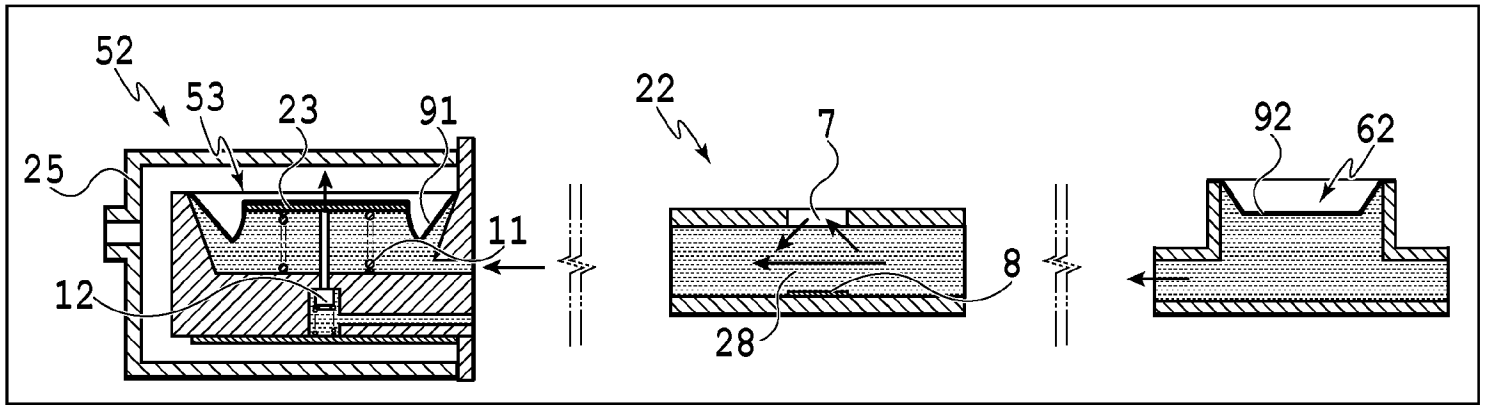
FIG. 5C illustrates the displacement path, the ejection port unit, and the second path.

FIG. 5A to FIG. 5C illustrate a displacement path 52, the ejection port unit 22, and a second path 62. As illustrated in FIG. 5A, the displacement path 52 includes: a first path 53 which includes a deformable region 91 formed from a flexible member and the valve mechanism 12 capable of supplying ink to the path; and the displacement unit 25 configured to cover the first path 53 and to deform the deformable region 91 by changing the pressure of the covered internal space. The plate member 23 is provided in the flexible member of the deformable region 91 of the first path 53 and is urged by the spring 11 in a direction (upper side in the view) to expand the deformable region 91. The second path 62 is provided with a deformable region 92 formed from a flexible member.

As illustrated in FIG. 5B, once the deformable region 91 is deformed by pumping air into the displacement unit 25 and increasing the pressure thereinside, then the ink inside the first path 53 starts to move, resulting in a flow from the first path 53 toward the ejection port unit 22 and a flow from the ejection port unit 22 toward the second path 62. The flow of the ink generated in the first path 53 will flow through the vicinity of the ejection port 7 at the ejection port unit 22, and in the second path 62 deforms the deformable region 92 so as to increase the volume of the second path 62. In this case, although the valve mechanism 12 becomes in an open state, the flow resistance is smaller in a flow flowing to the ejection port unit 22 from the first path 53 than in a flow flowing to the upstream side through the valve mechanism 12 from the first path 53, and therefore a flow toward the upstream side will not be generated.

Then, as illustrated in FIG. 5C, once the displacement unit 25 reduces the pressure thereinside (the pumping of air is stopped to release the inside to the atmosphere), then the deformable region 92 which has been deformed will return to the state before deformation along with the action of the spring 11. This results in a flow from the ejection port unit 22 toward the displacement path 52 and a flow from the second path 62 toward the ejection port unit 22. In the second path 62, a flow generated in the ejection port unit 22 will, while the deformable region 92 is deforming so as to reduce its volume, go through the vicinity of the ejection port 7 in the ejection port unit 22 to stir the ink in the vicinity of the ejection port.

In this embodiment, the probability of failures, such as breaking of the deformable region 91, can be reduced because deforming the deformable region 91 by the displacement unit 25 is performed without contact, unlike the first and second embodiment. Moreover, because the deformation in the deformable region 91 can be controlled by pumping-in and pumping-out the air of the internal space, the displacement unit 25 can be miniaturized.

Note that, in this embodiment, air is used in order for the displacement unit 25 to deform the deformable region 91, but not limited thereto, any fluid may be used.

By repeating such a series of actions, the ink thickened in the ejection port unit 22 is swung and stirred to mix up with the un-thickened ink in the peripheral thereof, allowing the thickening of ink in the ejection port unit 22 to be dissolved. As a result, compared with a method of recovering an ejection state by discharging the thickened ink from the ejection port unit 22, it is possible to recover an ejection state in the ejection port unit 22 while suppressing the amount of ink to discharge, and it is possible to suppress the occurrence of printing failures associated with the thickening of ink.

Fourth Embodiment

Hereinafter, a fourth embodiment of the present invention will be explained with reference to the accompanying drawings. Note that, because the basic configuration of this embodiment is the same as the configurations of the previous embodiments, hereinafter only characteristic configurations will be explained.

In the first to third embodiments, both the first path and the second path correspond to one ejection port, but in this embodiment a configuration will be explained, in which both the first path and the second path correspond to a plurality of ejection ports.

Figure 6A:
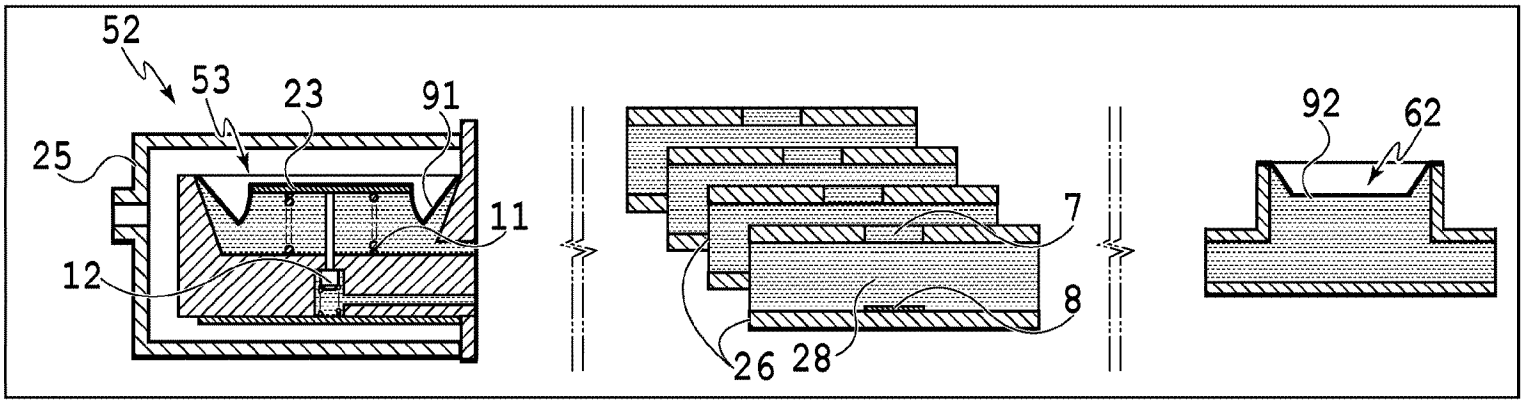
FIG. 6A illustrates the displacement path, the ejection port unit, and the second path.
Figure 6B:
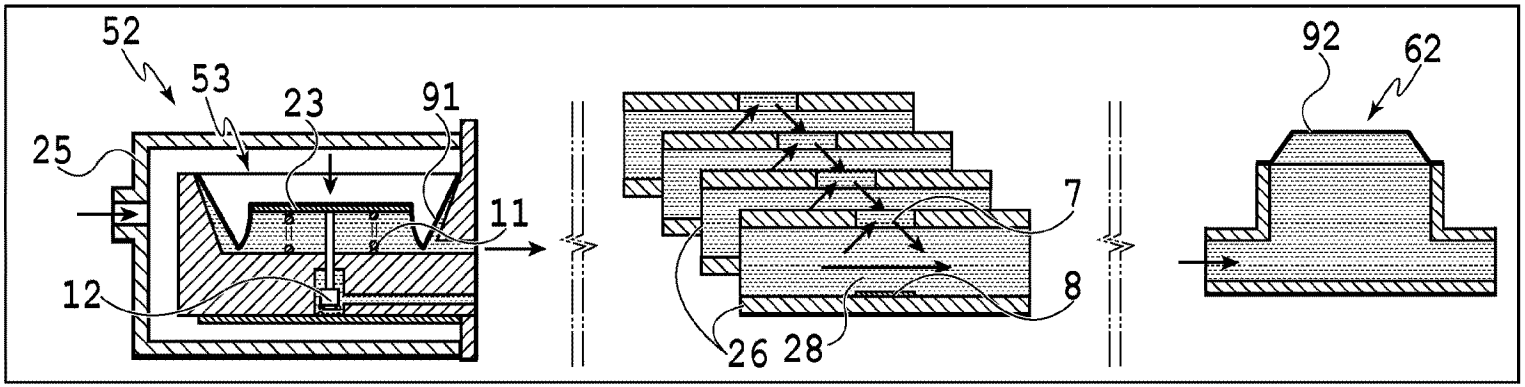
FIG. 6B illustrates the displacement path, the ejection port unit, and the second path.
Figure 6C:
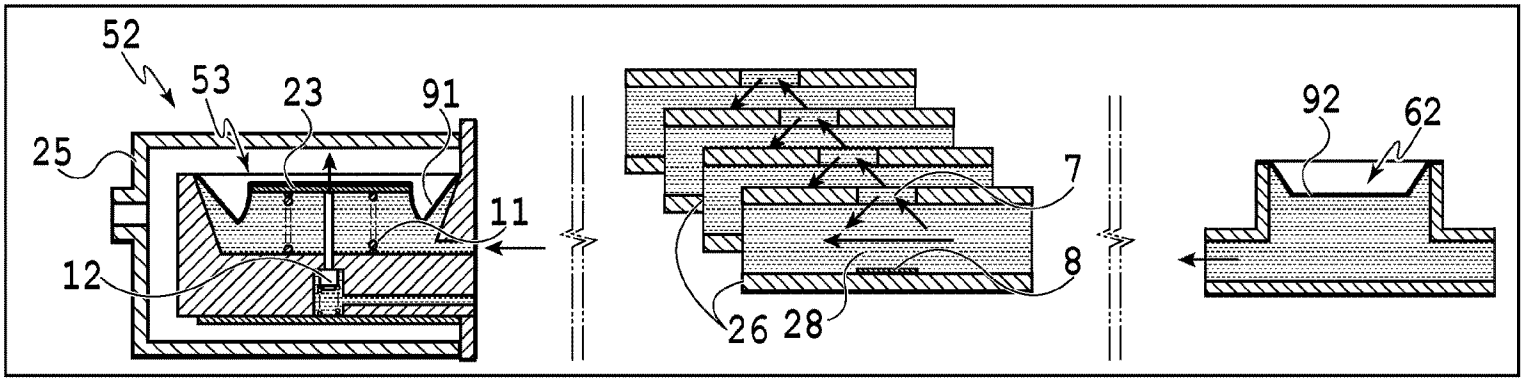
FIG. 6C illustrates the displacement path, the ejection port unit, and the second path.

FIG. 6A to FIG. 6C illustrate the displacement path 52, an ejection port unit 26, and the second path 62. As illustrated in FIG. 6A, the displacement path 52 includes: the first path 53 which includes a deformable region 91 formed from a flexible member and the valve mechanism 12 capable of supplying ink to the path; and the displacement unit 25 configured to cover the first path 53 and to deform the deformable region 91 by changing the pressure of the covered internal space. The plate member 23 is provided in the flexible member of the deformable region 91 of the first path 53 and is urged by the spring 11 in a direction (upper side in the view) to expand the deformable region 91. The plurality of ejection port units 26 are connected to the first path 53 and the second path 62. The second path 62 is provided with the deformable region 92 formed from a flexible member.

As illustrated in FIG. 6B, once the deformable region 91 is deformed by pumping air into the displacement unit 25 and increasing the pressure thereinside, then the ink inside the first path 53 starts to move, resulting in a flow of ink from the first path 53 toward the plurality of ejection ports 26 and a flow of ink from the plurality of ejection port units 26 toward the second path 62. The flow of ink generated in the first path 53 goes through the vicinity of ejection port 7 in the plurality of ejection port units 26, and in the second path 62 deforms the deformable region 92 so as to increase the volume of the second path 62.

Then, as illustrated in FIG. 6C, once the internal pressure is reduced by the displacement unit 25, then the deformable region 92 which has been deformed will return to the state before deformation along with the action of the spring 11. This results in a flow from the plurality of ejection port units 26 toward the displacement path 52 and a flow of ink from the second path 62 toward the plurality of ejection port units 26. In the second path 62, a flow generated in the plurality of ejection port units 26 will, while the deformable region 92 is deforming so as to reduce its volume, go through the vicinity of the ejection port 7 in the plurality of ejection port units 26 to stir the ink in the vicinity of the ejection port.

By repeating such a series of actions, the ink thickened in the plurality of ejection port units 26 is swung and stirred to mix up with the un-thickened ink in the peripheral thereof, allowing the thickening of ink in the plurality of ejection port units 26 to be dissolved. As a result, compared with a method of recovering an ejection state by discharging the thickened ink from the plurality of ejection port units 26, it is possible to recover an ejection state in the plurality of ejection port units 26 while suppressing the amount of ink to discharge, and it is possible to suppress the occurrence of printing failures associated with the thickening of ink.

Fifth Embodiment

Hereinafter, a fifth embodiment of the present invention will be explained with reference to the accompanying drawings. Note that, because the basic configuration of this embodiment is the same as the configurations of the previous embodiments, hereinafter only characteristic configurations will be explained.

Figure 7:
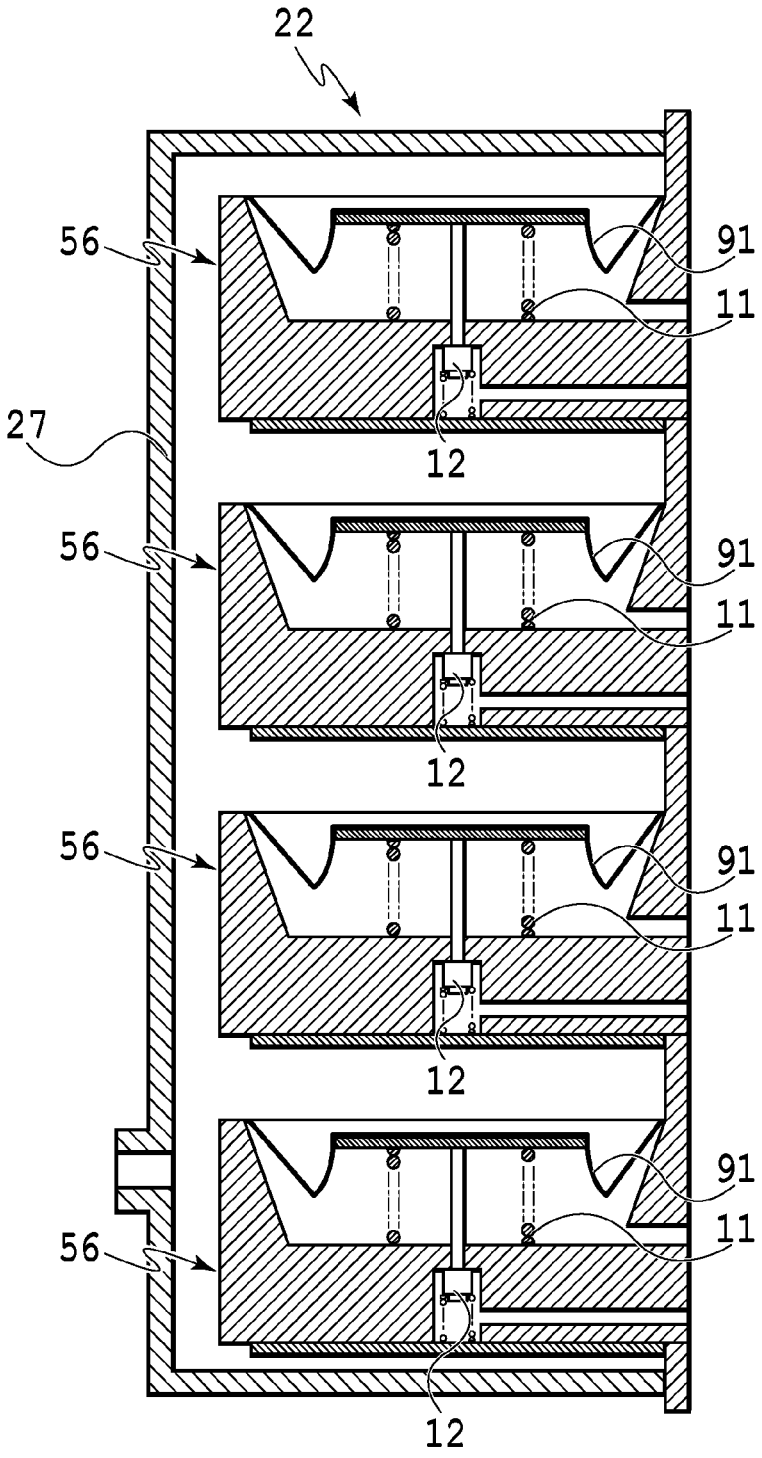
FIG. 7 illustrates a displacement path.

FIG. 7 illustrates a displacement path 55 of this embodiment. In the displacement path 55 in this embodiment, a displacement unit 27 covers four first paths 56, so is capable of simultaneously deforming each deformable region 91 by changing the pressure of the covered internal space. The configuration of the first path 56 is the same as that of the third and fourth embodiments. Note that, in this embodiment, the four first paths 56 are covered with the displacement unit 27, but not limited thereto, the displacement unit 27 may cover the plurality of first paths 56 so as to be able to deform the plurality of deformable regions 91 simultaneously. By changing the pressure of the internal space covered with the displacement unit 27 and simultaneously deforming the respective deformable regions 91, the ink inside each first path 56 starts to move, resulting in a flow from each first path 56 toward the ejection port unit connected to each path and a flow from the ejection port unit toward the second path.

Even in a case where ink is supplied to the ejection port unit using such a displacement path 55, the ink thickened in the ejection port unit is swung and stirred to mix up with the un-thickened ink in the peripheral thereof, so that it is possible to recover an ejection state in the ejection port unit, and it is possible to suppress the occurrence of printing failures associated with the thickening of ink.

OTHER EMBODIMENTS

The present invention consists in swinging and stirring ink with two paths sandwiching an ejection port unit and in recovering an ejection state in the ejection port unit. Therefore, as long as ink can be displaced, swung, and stirred with a first path and a second path, the first path and the second path may be incorporated into an ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A liquid ejection apparatus comprising:

an ejection port unit including a pressure chamber and an ejection port, the ejection port unit being configured to eject liquid from the ejection port, the pressure chamber having an energy generation element for generating energy for ejecting liquid from the ejection port;

a first path for liquid to flow into the ejection port unit, the first path having a first deformable region at a portion in contact with the liquid flowing through the first path, the first deformable region of the first path being formed from a flexible member;

a second path for liquid to flow out of the ejection port unit, the second path having a second deformable region at a portion in contact with the liquid flowing through the second path, the second deformable region of the second path being formed from a flexible member, the pressure chamber being positioned between the first path and the second path; and a displacement unit configured to deform the first deformable region, the displacement unit being configured to deform the first deformable region in a direction that the volume of the first path contracts to deform the second deformable region in a direction that the volume of the second path expands, so that the liquid inside the pressure chamber flows in the direction from the first path toward the second path, the displacement unit being configured to retreat to cause the first deformable region to restore to its original shape, so that the liquid in the pressure chamber flows from the pressure chamber toward the first path.

2. The liquid ejection apparatus according to claim 1, wherein the pressure chamber includes an energy generation element for generating the energy for ejecting liquid therein.

3. The liquid ejection apparatus according to claim 1, wherein the first path includes a valve capable of supplying liquid to the ejection port unit.

4. The liquid ejection apparatus according to claim 3, wherein the flexible member of the first deformable region of the first path is urged by a spring, and the valve is closed by urging force of the spring.

5. The liquid ejection apparatus according to claim 1, wherein the ejection port is one of a plurality of ejection ports and the first path is connected to the plurality ejection ports.

6. A recovery method in a liquid ejection apparatus, the liquid ejection apparatus including (i) a pressure chamber which includes an energy generation element therein for generating energy for ejecting liquid, (ii) a first path for liquid to flow into the pressure chamber, and (iii) a second path for liquid to flow out of the pressure chamber, (iv) the pressure chamber being positioned between the first path and the second path, the method comprising the steps of:

providing a first deformable region in the first path, the first deformable region being configured to change the volume of the first path;

providing a second deformable region in the second path, the region second deformable being configured to change the volume of the second path;

deforming, by a displacement unit configured to deform the first deformable region, the first deformable region in the direction that the volume of the first path contracts so as to cause liquid inside the pressure chamber to flow in a direction from the first path toward the second path; and retreating the displacement unit to cause the first deformable region to restore to its original shape so as to cause the liquid in the pressure chamber to flow from the pressure chamber toward the first path.

* * * * *